US007235763B2

(12) United States Patent
Christiaansen et al.

(10) Patent No.: US 7,235,763 B2
(45) Date of Patent: Jun. 26, 2007

(54) COOKING APPLIANCE INCLUDING COMBINATION HEATING SYSTEM

(75) Inventors: Jeffrey A. Christiaansen, Williamsburg, IA (US); Edward R. Cook, Cedar Rapids, IA (US)

(73) Assignee: AGA Foodservice Group, Amana, IA (US)

( * ) Notice: Subject to any disclaimer, the term of this patent is extended or adjusted under 35 U.S.C. 154(b) by 0 days.

(21) Appl. No.: 10/991,929

(22) Filed: Nov. 19, 2004

(65) Prior Publication Data

US 2005/0236402 A1 Oct. 27, 2005

Related U.S. Application Data

(60) Provisional application No. 60/560,282, filed on Apr. 8, 2004.

(51) Int. Cl.
*H05B 6/80* (2006.01)
*H05B 6/68* (2006.01)

(52) U.S. Cl. ..... 219/681; 219/685; 219/460

(58) Field of Classification Search ..... 219/681, 219/702, 710, 720, 400, 682, 683, 685, 401, 219/754, 757, 391; 126/21 A; 99/451, 468, 99/474, 467, 325, 330
See application file for complete search history.

(56) References Cited

U.S. PATENT DOCUMENTS 3,324,844 A 6/1967 Huffman
4,108,139 A 8/1978 Gilliom et al.
4,137,442 A 1/1979 Tateda
4,163,894 A * 8/1979 Scherer ..... 219/391
4,332,992 A 6/1982 Larsen et al.
4,335,290 A 6/1982 Teich
4,395,233 A 7/1983 Smith et al.
4,430,541 A 2/1984 Day, Jr.
4,431,889 A 2/1984 Saponara et al.
4,477,706 A * 10/1984 Mittelsteadt ..... 219/681
4,556,043 A * 12/1985 Bratton ..... 126/21 A
4,585,923 A 4/1986 Binder
4,591,333 A 5/1986 Henke
4,627,409 A 12/1986 Kagomoto
4,700,051 A * 10/1987 Goessler et al. ..... 219/448.11

(Continued)

FOREIGN PATENT DOCUMENTS

EP 809418 11/1987

(Continued)

*Primary Examiner*—Quang Van
(74) *Attorney, Agent, or Firm*—Diederiks & Whitelaw PLC

(57) ABSTRACT

A cooking appliance includes a heating system capable of combining radiant, convection, microwave and conduction heating techniques to perform a cooking operation. The cooking appliance includes a cooking chamber and a bifurcated air plenum having an angled divider that defines a tapered air delivery portion and a tapered exhaust portion. The tapered air delivery portion actually guides a convective air flow through an air emitter plate positioned at a top of the cooking chamber. The air emitter plate includes a recessed, serpentine-like channel having a plurality of openings that lead to the air delivery portion. A radiant heating element is nested within the recessed channel. The cooking appliance further includes a convection fan, as well as a magnetron having a rotatable antenna positioned below the cooking chamber and a conductive plate upon which food to be cooked is supported.

16 Claims, 5 Drawing Sheets

U.S. PATENT DOCUMENTS 4,761,529 A * 8/1988 Tsisios ..... 219/685
4,870,255 A 9/1989 Fujii et al.
4,940,869 A 7/1990 Scholtes et al.
4,951,645 A 8/1990 Luebke et al.
5,082,999 A 1/1992 Yamaguchi et al.
5,204,503 A 4/1993 Maiellano, Jr. et al.
5,254,823 A 10/1993 McKee et al.
5,272,299 A 12/1993 Ovadia
5,309,981 A 5/1994 Binder
5,434,390 A 7/1995 McKee et al.
5,517,005 A * 5/1996 Westerberg et al. ..... 219/685
5,558,793 A 9/1996 McKee et al.
5,601,070 A 2/1997 Hotard et al.
5,655,511 A 8/1997 Prabhu et al.
5,756,974 A 5/1998 Hong
5,798,505 A * 8/1998 Lee ..... 219/681
5,877,479 A * 3/1999 Yu ..... 219/754
5,927,265 A 7/1999 McKee et al.
6,008,483 A 12/1999 McKee et al.
6,049,066 A 4/2000 Wilson
6,058,924 A 5/2000 Pool, III et al.
6,060,701 A * 5/2000 McKee et al. ..... 219/681
6,093,918 A 7/2000 Sohn
6,114,664 A 9/2000 Cook et al.
6,218,650 B1 4/2001 Tsukamoto et al.
6,218,651 B1 4/2001 Chung
6,227,189 B1 5/2001 Dougherty
6,250,296 B1 6/2001 Norris et al.
6,262,396 B1 7/2001 Witt et al.
6,262,406 B1 7/2001 McKee et al.
6,291,808 B1 9/2001 Brown
6,307,185 B1 10/2001 Loveless
6,337,468 B1 1/2002 Worthington et al.
6,359,271 B1 3/2002 Gidner et al.
6,376,817 B1 4/2002 McFadden et al.
6,384,381 B2 5/2002 Witt et al.
6,399,930 B2 6/2002 Day et al.
6,403,937 B1 6/2002 Day et al.
6,472,640 B2 10/2002 Brown et al.
6,472,647 B2 10/2002 Lee et al.
6,486,453 B1 11/2002 Bales et al.
6,521,870 B2 2/2003 Nolan et al.
6,525,301 B1 2/2003 Graves et al.
6,528,773 B2 3/2003 Kim et al.
6,541,745 B2 4/2003 Kim et al.
6,541,746 B2 * 4/2003 Kim et al. ..... 219/681
6,555,791 B2 4/2003 Lubrina et al.
6,557,543 B2 5/2003 Cole et al.
6,566,638 B2 5/2003 Brown
6,595,117 B1 7/2003 Jones et al.
6,603,102 B2 8/2003 Brown et al.
6,817,283 B2 11/2004 Jones et al.
6,909,079 B2 * 6/2005 Lee et al. ..... 219/757
2002/0134778 A1 9/2002 Day et al.

FOREIGN PATENT DOCUMENTS

GB 2190486 11/1987

* cited by examiner

COOKING APPLIANCE INCLUDING COMBINATION HEATING SYSTEM

CROSS-REFERENCE TO RELATED APPLICATION

The present application claims the benefit of U.S. Provisional Patent Application Ser. No. 60/560,282 entitled "Cooking Appliance Including Combination Heating System" filed Apr. 8, 2004.

BACKGROUND OF THE INVENTION

1. Field of the Invention

The present invention pertains to the art of cooking appliances and, more particularly, to a compact cooking appliance capable of combining radiant, convection, conduction and microwave heating techniques to perform a cooking operation.

2. Discussion of the Prior Art

There exist a wide range of cooking appliances on the market. Many of these cooking appliances are designed for use in cooking various types of food products in different ways. For instance, where more conventional cooking appliances generally relied upon radiant energy as the sole heat source, more recent trends combine a radiant heat source with convection, microwave or conduction heating techniques, thereby increasing the versatility of the cooking appliance while potentially shortening required cook times. In particular, the prior art contains examples of appliances that combine radiant and convection cooking; convection, microwave and radiant cooking; and microwave, convection and conduction heating techniques.

Regardless of the existence of these known arrangements, there still exists a need for a cooking appliance that combines each of radiant, convection, microwave and conduction heating techniques in an efficient and effective manner to handle a wide range of food items. Particularly, there exists a need for a cooking appliance that can be used to rapidly prepare food products that require numerous different heat sources for full and complete cooking. For example, the rapid preparation of commercially produced, open-faced grilled sandwiches raises various cooking concerns. Open-faced grilled sandwiches require, at the very least, that heat be directed both downward onto an upper portion of the sandwich and upward onto a lower bun portion of the sandwich. In most cases this is accomplished by passing the open-faced sandwich on a conveyor belt through an oven between opposing radiant heat sources. While effective to a degree, the process can be time consuming and really does not result in a uniform heating of the meat, cheese and/or other toppings on the bread, nor an even toasting of the bread itself. In addition to this potential problem, a dual radiant oven of this type is simply not suitable for many other applications. For instance, an additional microwave oven or the like would typically be employed to heat soup or other liquid-based food items.

Regardless of the variety of known cooking appliances, there exists the need for a versatile cooking appliance that can preferably take advantage of radiant, convection, microwave and conduction cooking techniques such that the appliance can be used to rapidly and effectively cook a wide range of food items. Particularly, there exists a need for a cooking appliance that can establish a synergism between these various heating techniques in order to enhance the overall efficiency and effectiveness of the appliance. In addition, there exists a need in the art for a cooking appliance which can provide for both a convection air flow and with a suitable cooling air flow for heat generating components.

SUMMARY OF THE INVENTION

The present invention is directed to a cooking appliance including a cooking chamber having top, bottom, rear and opposing side walls, at least one radiant heating element exposed to the cooking chamber, a convection fan, a microwave heating device having at least one rotatable antenna and a conduction heating device, all of which can be operated in combination to perform a cooking operation. The cooking appliance also includes an air plenum arranged at a top portion of the cooking chamber. The air plenum is bifurcated so as to define two distinct passages separated by an angled divider. The angled divider defines a tapered air delivery portion and a tapered exhaust portion within the bifurcated air plenum. The tapered air delivery portion guides a convective air flow through an air emitter plate positioned at the top wall of the cooking chamber.

In further accordance with the invention, the air emitter plate includes a recessed, serpentine-like channel having a plurality of openings that lead to the air delivery portion. Nested within the recessed channel is the radiant heating element. With this arrangement, not only does the radiant heating element deliver radiant heat, but heat is transferred from the radiant heating element to the convection cooking air delivered into the cooking chamber. The air currents are furnished by a convection fan positioned in a fan housing, preferably arranged behind the cooking chamber.

In still further accordance with the invention, the cooking appliance includes a cooling fan arranged in a housing located behind the fan housing. The cooling fan draws an ambient air flow into the cooking appliance through an air intake that extends below the cooking chamber. A first portion of the intake air flow is preferably directed to the convection fan, while a second or major portion of the air flow is used to cool control elements, such as control boards, electronics, relays and the like arranged in the appliance. Preferably, the cooling fan is drivingly connected to the convection fan. With this arrangement, activation of the cooling fan establishes both the intake air flow for cooling system components and a fresh convection air flow supply that combines with other heating techniques to perform the combined cooking operation.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
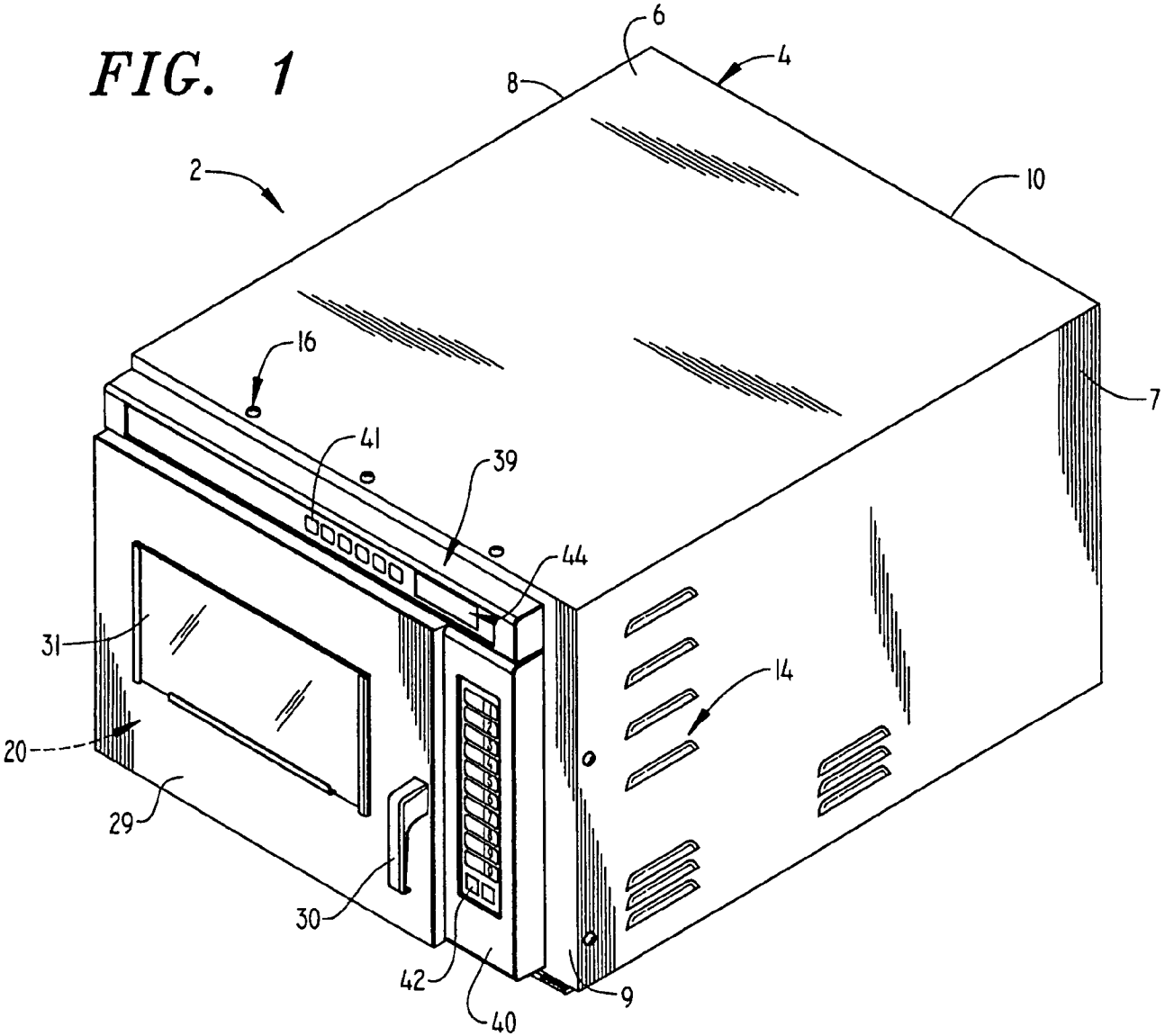
FIG. 1 is an upper right perspective view of a cooking appliance incorporating a combination heating system constructed in accordance with the present invention.
Figure 2:
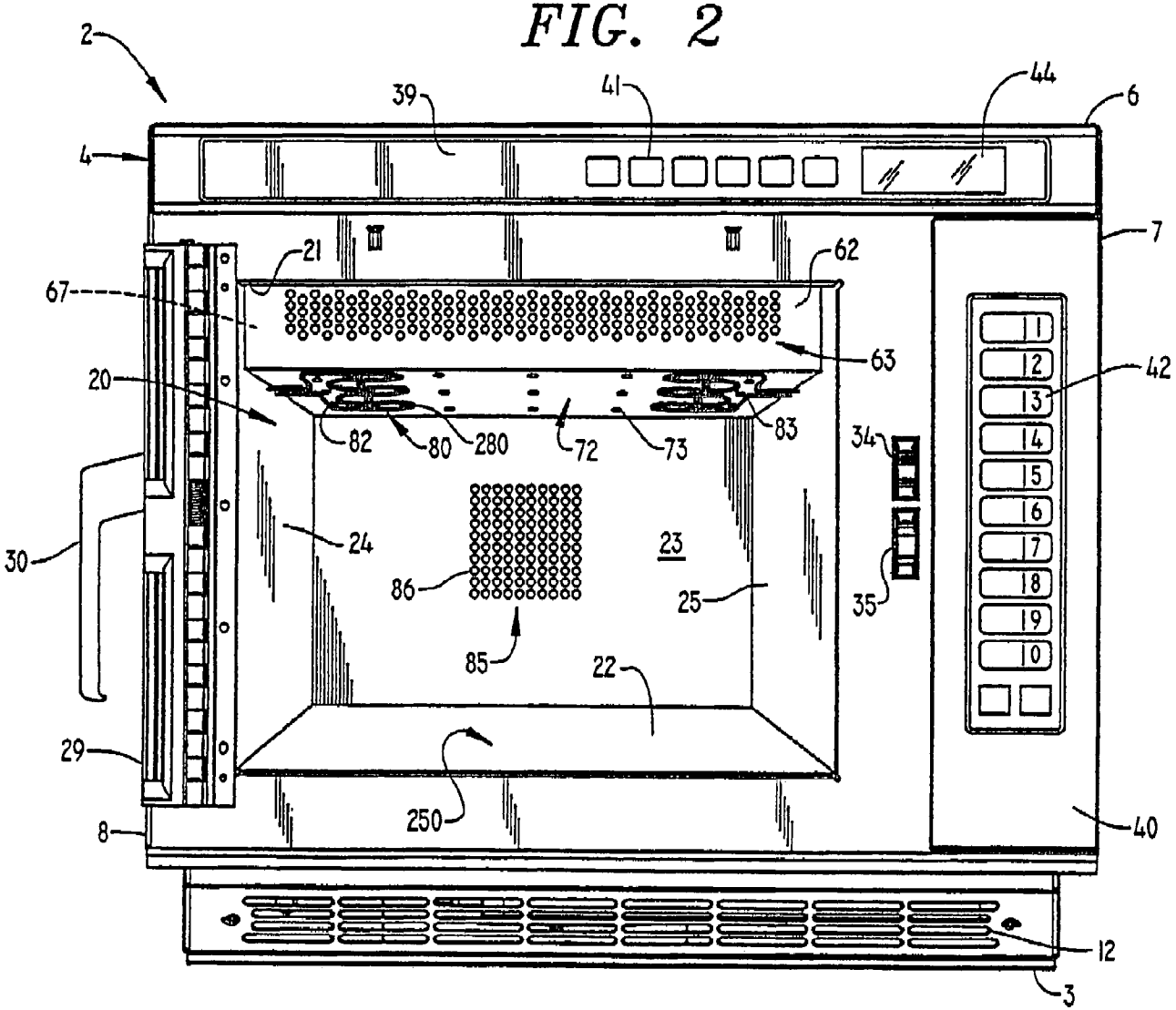
FIG. 2 is a front view of the cooking appliance of FIG. 1 with a cooking chamber of the appliance exposed.
Figure 3:
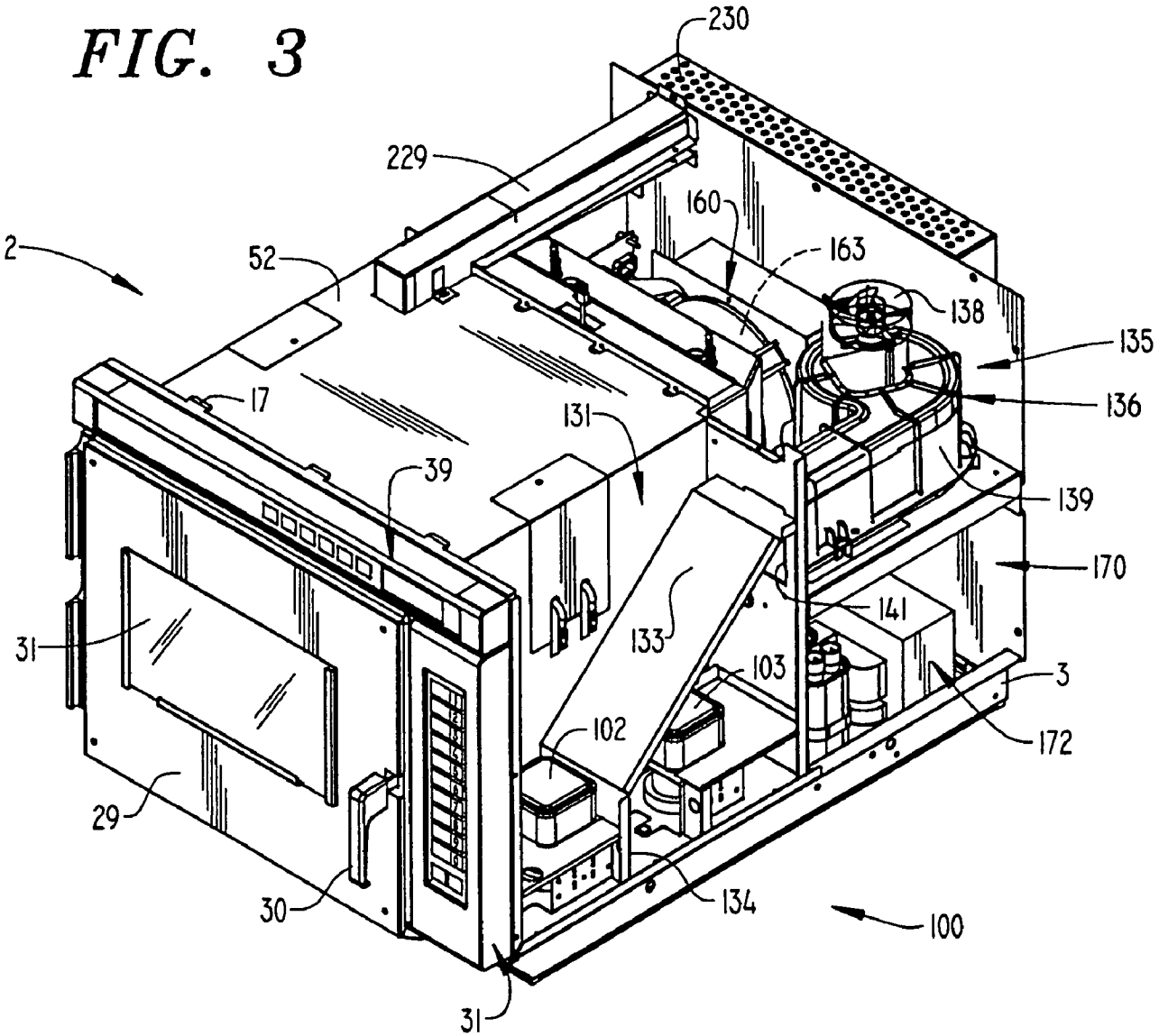
FIG. 3 is an upper right perspective view of the cooking appliance of FIG. 1 with an outer cabinet portion of the appliance removed.

With initial reference to FIGS. 1–3, a cooking appliance constructed in accordance with the present invention is generally indicated at 2. As shown, cooking appliance 2 includes a base frame 3 to which is secured an outer cabinet shell 4 having top and opposing side panels 6–8. Cooking appliance 2 is also provided with a front face or wall 9 and a rear panel 10. Arranged at a lower portion of front wall 9 is an intake air vent 12 through which, as will be discussed more fully below, an ambient air flow enters into cabinet shell 4. In addition, cabinet shell 4 includes a plurality of air discharge vents, indicated generally at 14, arranged on side panel 7. Vents 14 enable cooling air to exit from within cooking appliance 2, thereby removing heat from within cabinet shell 4. Cabinet shell 4 is secured over base frame 3 through a plurality of fasteners 16, with the fasteners 16 arranged along front wall 9 being secured at tabs 17 (see FIG. 3).

As best seen in FIG. 2, arranged within cabinet shell 4 is a cooking chamber 20 having top, bottom, rear and opposing side walls 21–25. In a manner known in the art, a door 29 is pivotally mounted to front wall 9 to selectively enable access to cooking chamber 20. Toward that end, door 29 includes a handle 30 and a window 31 for viewing the contents of cooking chamber 20 during a cooking operation. Although not shown, window 31 includes a screen (not shown) that prevents microwave energy fields from escaping from within cooking chamber 20 during a cooking operation. Handle 30 is adapted to interconnect to upper and lower latching mechanisms 34 and 35 so as to retain door 29 in a closed position and prevent operation of cooking appliance 2 whenever door 29 is opened.

Cooking appliance 2 is shown to include upper and side control panels 39 and 40, each of which includes a respective set of control buttons or elements 41 and 42. The sets of control elements 41 and 42, in combination with a digital display 44, enable a user to establish particular cooking operations for cooking appliance 2. For instance, control elements 41 can be used to establish the heating parameters of cooking appliance 2, while control elements 42 enable stored cooking times and/or operations to be readily selected. Since the general programming of cooking appliance 2 does not form part of the present invention, these features will not be described further herein.

As further shown in FIG. 2, cooking appliance 2 includes a plenum cover 62 arranged at an upper portion of cooking chamber 20. As will be discussed more fully below, plenum cover 62 includes a plurality of openings, indicated generally at 63, that enable an exhaust air flow to pass from cooking chamber 20. Arranged behind plenum cover 62 is a bifurcated air plenum 67 (see FIG. 4) that provides air flow management for cooking chamber 20 during a cooking operation. More specifically, an air emitter plate 72 extends rearward from a lower portion of plenum cover 62 to rear wall 23 of cooking chamber 20. In accordance with a preferred embodiment of the invention, air emitter plate 72 includes a plurality of strategically placed openings 73 that are exposed to a lower portion of bifurcated plenum 67. A radiant heating device 80, including first and second radiant heating elements 82 and 83 (see FIG. 2), preferably extends along air emitter plate 72. More specifically, radiant heating elements 82 and 83 are constituted by sheathed, electric resistive elements, each having a serpentine-like pattern that extends fore-to-aft across a section of air emitter plate 72. In the most preferred embodiment, each heating element 82, 83 is capable of delivering 900 watts of energy into cooking chamber 20. More preferably, each heating element 82, 83 is configured to produce 60 watts/in$^2$ of power. Cooking appliance 2 also includes a convection air intake vent 85 having a plurality of convection air openings 86 positioned on rear wall 23 of cooking chamber 20.

Figure 4:
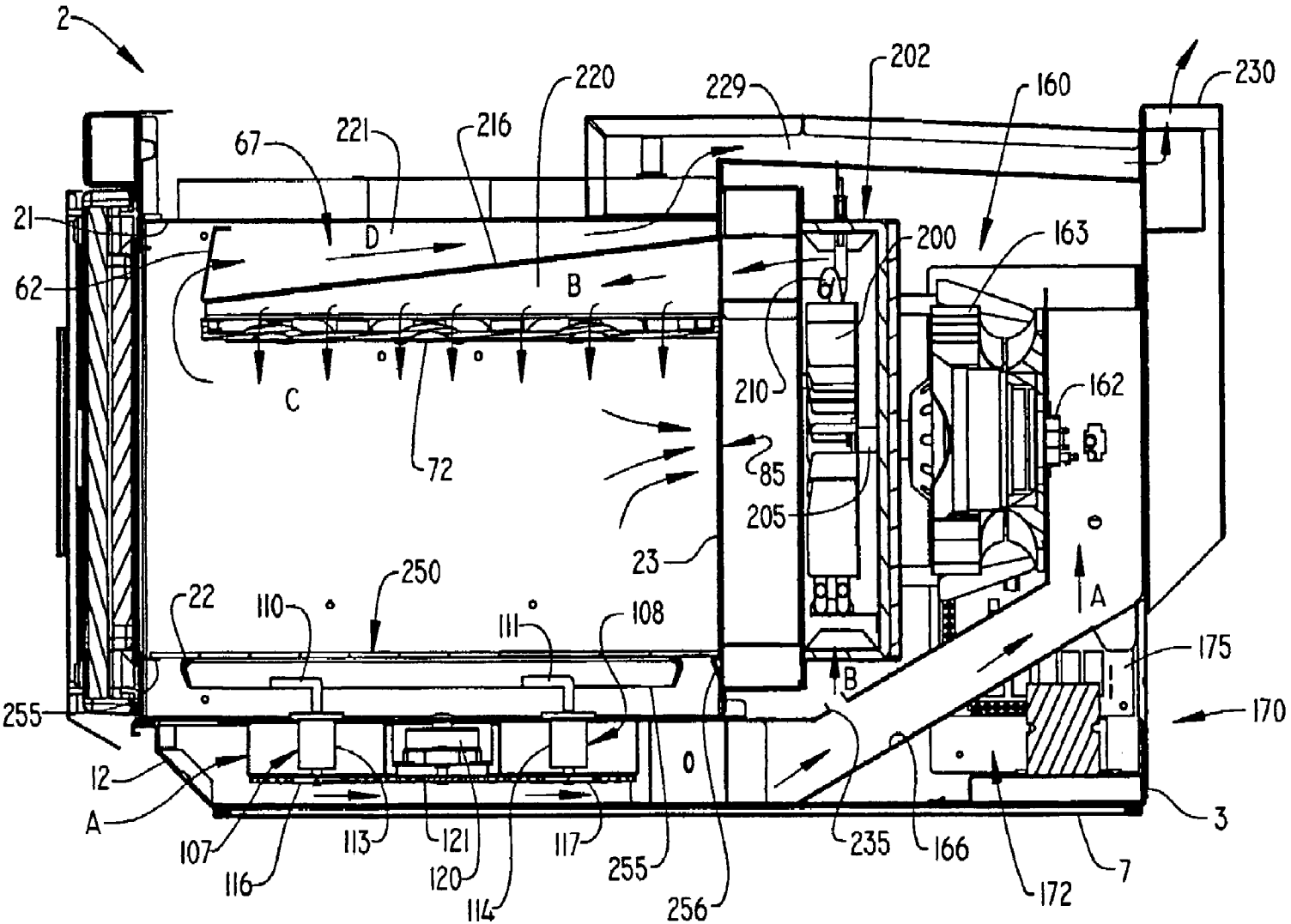
FIG. 4 is a cross-sectional side view of the cooking appliance constructed in accordance with the present invention.

As shown best with reference to FIGS. 3 and 4, cooking appliance 2 includes a microwave heating device 100 incorporating first and second magnetrons 102 and 103 (see FIG. 3) that are adapted to generate and direct a combined microwave energy field into cooking chamber 20. As seen in FIG. 4, first and second magnetrons 102 and 103 include respective first and second rotating antenna assemblies 107 and 108. Each rotating antenna assembly 107, 108 includes an antenna portion 110, 111, a housing portion 113, 114 and a gear member 116, 117 respectively. In accordance with a preferred form of the invention, antenna assemblies 107 and 108 are arranged below bottom wall 22 of cooking chamber 20. In further accordance with the invention, antenna portions 110 and 111 are rotated so as to develop a uniform, constructive standing microwave energy field within cooking chamber 20. That is, antenna assemblies 107 and 108 are rotated by a drive motor 120 having a drive gear 121 which is drivingly connected to each of gears 116 and 117 of antenna assemblies 107 and 108, preferably through a gear train (not shown).

Referring to FIG. 3, magnetrons 102 and 103 are arranged in a microwave housing portion 131 of cooking appliance 2. Microwave housing portion 131 includes an angled divider 133 and a vertical divider 134. Although not shown, vertical divider 134 is formed with an opening leading beneath magnetron 102. In order to prevent magnetrons 102 and 103 from overheating, cooking appliance 2 is provided with a microwave cooling system 135 that includes a blower assembly 136 which is drivingly connected to a drive motor 138 positioned within a duct 139. Duct 139 extends from drive motor 138 to an opening 141 arranged below angled divider 133. With this arrangement, activation of cooking appliance 2 causes drive motor 138 to rotate, whereby blower assembly 136 establishes a cooling air flow. The cooling air flow is guided through opening 141 toward magnetron 103 due to the presence of angled divider 133. The cooling air flow circulates about magnetron 103, through vertical divider 134, across magnetron 102 and up along angled divider 133, in order to provide a cooling effect for magnetrons 102 and 103, before exiting cooking appliance 2 through vents 14.

In addition to microwave cooling system 135, cooking appliance 2 includes an air intake system 160 having an associated drive motor 162 coupled to an impeller 163. Drive motor 162 rotates impeller 163 so as to draw in an ambient air flow A through intake air vent 12. Intake air vent 12 leads to an intake air duct 166, while passing about drive motor 120 for antenna assemblies 107 and 108. A majority of the air flow A is circulated within a rear control housing portion 170 in order to cool a plurality of electronic components 172, including a main control board 175 which is adapted to receive input and/or programming instructions through control elements 41, 42 in order to establish and set various cooking operations for cooking appliance 2.

In addition to driving impeller 163, drive motor 162 operates a convection fan 200 positioned within a convection fan housing 202 that, in the embodiment shown, is arranged behind rear wall 23 of cooking chamber 20. More specifically, convection fan 200 is drivingly connected for concurrent rotation with impeller 163 through a drive shaft 205 such that operation of drive motor 162 is translated to convection fan 200 to establish a convective air flow B. Convective air flow B is passed over a convection air heating element 210 and delivered into cooking chamber 20 through openings 73 in air emitter plate 72. More specifically, as will be discussed further below, convective air flow B is directed into bifurcated air plenum 67 before passing into cooking chamber 20.

In further accordance with the preferred form of the invention, bifurcated air plenum 67 includes an angled divider plate 216 that defines a tapered air delivery portion 220 and a corresponding tapered exhaust portion 221. In the embodiment shown, air delivery portion 220 is essentially defined by air emitter plate 72, angled divider plate 216 and part of rear wall 23, while exhaust portion 221 is defined by plenum cover 62, top wall 21 and angled divider plate 216. In any event, air flow B developed through operation of convection fan 200 is heated by heating element 210, directed into air delivery portion 220 of bifurcated air plenum 67 and then lead into cooking chamber 20 through openings 73. The tapering of air delivery portion 220 is provided so that air initially entering bifurcated air plenum 67 from convection fan 200 passes through openings 73 in air emitter plate 72 with substantially the same pressure as air reaching an end portion (not separately labeled) of tapered air delivery portion 220.

As a portion of the cooking operation is constituted by convection heating, convective air flow B circulates about cooking chamber 20. This heated air flow has been found to particularly enhance the even cooking of a food item. As further represented in FIG. 4, a first portion of convective air flow B passes into convection air intake vent 85 through openings 86. The convective air flow B is heated/reheated by heating element 210 before being passed back into cooking chamber 20. At the same time, a second, preferably smaller portion of convective air flow B passes through openings 63 in plenum cover 62 and is directed out of cooking appliance 2. More specifically, plenum cover 62 leads into tapered exhaust portion 221. The exhaust air flow D entering into tapered exhaust portion 221 is passed upward into an exhaust duct 229 before exiting through an exhaust outlet 230 that, in the embodiment shown, is arranged at an upper rear portion of cooking appliance 2. To replace the lost air flow, convection fan 200 preferably draws or siphons a portion of air flow A. For this purpose, one or more openings 235 are provided in duct 166 in order to introduce fresh ambient air to the overall, circulating air flow. In this manner, certain cooking effluents, including moisture and steam, exit cooking chamber 20 through exhaust outlet 230, while a fresh supply of air is introduced into the remaining, recirculated air flow due to the presence of opening(s) 235.

In further accordance with the present invention, cooking appliance 2 includes a conductive heating device 250 that, in the most preferred form of the invention, defines bottom wall 22 of cooking chamber 20. Conductive heating device 250 is preferably constituted by a ceramic stone plate adapted to support food items within cooking chamber 20. Conductive heating device 250 advantageously provides a thermal conduction path for heating and browning of a food item. More specifically, upon activation of cooking appliance 2, radiant heat produced by heating elements 82 and 83 combines with convective air flow B generated by convection fan 200 to heat conduction heating device 250. Conductive heating device 250 is transparent to microwave energy so that microwave energy fields emitted by magnetrons 102 and 103 pass upward into cooking chamber 20 and further contribute to the overall cooking operation. In further accordance with the invention, conductive heating device 250 is supported upon a plurality of support brackets, such as those indicated at 255 and 256, to enable or facilitate removal of conductive heating device 250 for cleaning or other purposes.

Figure 5:
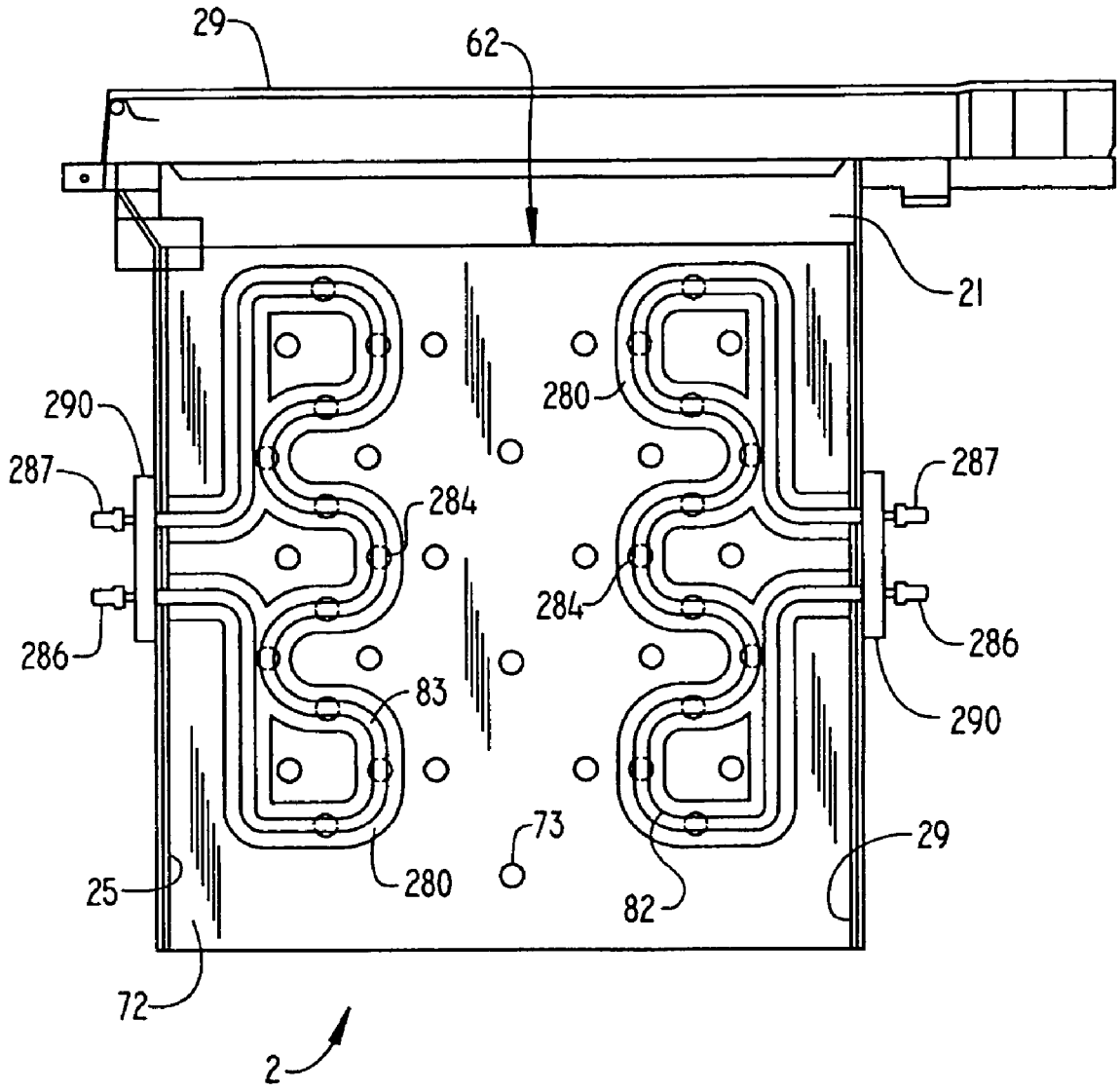
FIG. 5 is a plan view of a top portion of a cooking chamber of the appliance.

With particular reference to FIG. 5, air emitter plate 72 is preferably formed from anodized cast aluminum and provided with a pair of fore-to-aft extending recessed channels 280. Recessed channels 280 are provided with a plurality of openings 284. Heating elements 82 and 83 are nested within recessed channels 280 adjacent openings 284. As shown, each heating element 82, 83 includes a pair of electrodes 286 and 287 spaced from side walls 24 and 25 by an insulator 290. With this mounting arrangement, not only do heating elements 82 and 83 provide a source of radiant heat, but convective air flow B passing through openings 284 is heated by the additional thermal energy generated by heating elements 82 and 83 as air flow B passes from air delivery portion 210 of air plenum 67 into cooking chamber 20. Therefore, by being routed between, across and around respective ones of the various strategically placed openings 284, heating elements 82 and 83 evenly distribute thermal and infrared energy to the food being cooked.

With this overall combined cooking arrangement, a food item, for example, an open-faced sandwich placed within cooking chamber 20, can be exposed to a four-way combination cooking operation, i.e. radiant, microwave, convection and conductive heating techniques. The combination of the aforementioned heating techniques serves to cook the food item in an expeditious manner, while maintaining the required food quality. In addition, combining the aforementioned heating techniques enables cooking appliance 2 to be readily adapted to cook a wide range of food items in an efficient and effective manner, while also establishing an overall compact unit.

Although described with reference to a preferred embodiment of the present invention, it should be readily apparent to one of ordinary skill in the art that various changes and/or modifications can be made to the invention without departing from the spirit thereof. For instance, the particular location of the magnetrons and antennas could vary. In addition, a waveguide could be employed to deliver microwave energy fields into the cooking chamber. Furthermore, the particular number and arrangement of the control elements is for exemplary purposes only and could vary without departing from the spirit of the present invention.

We claim:

1. A cooking appliance comprising:

a cabinet including top, bottom rear and opposing side walls;

a cooking chamber including top, bottom, rear and opposing side walls and a frontal opening;

a door movably mounted relative to the cooking chamber for selectively closing the frontal opening;

a fan housing arranged between the rear wall of the cooking chamber and the rear wall of the cabinet;

a bifurcated air plenum arranged at the top wall of the cooking chamber, said bifurcated air plenum including an angled divider defining a tapered air delivery portion and a tapered exhaust portion;

an ambient air intake plenum extending below the bottom wall leading to the fan housing;

an air emitter plate forming a portion of the top wall of the cooking chamber, said air emitter plate including a plurality of apertures leading to the air delivery portion and a recessed channel, integrally formed in the air emitter plate, including a plurality of openings that lead to the air delivery portion said openings passing heated air into the cooking chamber;

a radiant heating device positioned in the cooking chamber and nested at least partially within the recessed channel with the openings in the recessed portion directing air currents past the radiant heating device into the cooking chamber for performing a portion of a cooking operation;

a microwave heating device including a rotatable antenna arranged to deliver a microwave energy field into the cooking chamber;

a convection fan arranged in the fan housing directing a convective air flow into the cooking chamber, said convection fan combining an air flow received from the cooking chamber and the air intake plenum to be directed into the air delivery portion of the bifurcated air plenum; and a conduction heating device arranged in the cooking chamber for supporting a food item, said conduction heating device being heated by the radiant heating device, the microwave heating device and the convection fan to form a combined heating process for cooking the food item.

2. A cooking appliance comprising:

a cabinet including top, bottom rear and opposing side walls;

a cooking chamber including top, bottom, rear, opposing side walls and a frontal opening;

a door movably mounted relative to the cooking chamber for selectively closing the frontal opening;

a fan housing arranged between the rear wall of the cooking chamber and the rear wall of the cabinet;

a bifurcated air plenum arranged at the top wall of the cooking chamber, said bifurcated air plenum including an angled divider defining a tapered air delivery portion and a tapered exhaust portion;

an ambient air intake plenum extending below the bottom wall leading to the fan housing; and an air emitter plate forming a portion of the top wall of the cooking chamber, said air emitter plate including a plurality of apertures leading to the air delivery portion and a recessed channel including a plurality of openings that lead to the air delivery portion said openings passing heated air into the cooking chamber.

3. The cooking appliance according to claim 2, wherein the tapered exhaust air portion extends to the rear of the cooking appliance between the top wall of the cabinet and the top wall of the cooking chamber.

4. The cooking appliance according to claim 3, further comprising: an exhaust air inlet cover including a plurality of vents that lead into the tapered exhaust portion of the bifurcated air plenum.

5. The cooking appliance according to claim 4, wherein the exhaust air inlet extends downward from the top wall of the cooking chamber, across the bifurcated air plenum and joins the air emitter plate with the plurality of vents being adjacent the frontal opening.

6. The cooking appliance according to claim 5, further comprising: an exhaust air outlet vent arranged leading through the rear wall of the cabinet wherein, an exhaust air flow enters the plurality of vents, travels through the tapered exhaust duct and exits the cooking appliance through the exhaust air outlet vent.

7. The cooking appliance according to claim 2, further comprising: a cooling fan chamber including a cooling fan assembly arranged between the fan housing and the rear wall of the cabinet said cooling fan assembly establishing a cooling air flow.

8. The cooking appliance according to claim 7, further comprising: at least one magnetron, said cooling air flow being directed over the at least one magnetron.

9. The cooking appliance according to claim 7, wherein the cooling fan assembly is drivingly connected to the convection fan such that rotation of the cooling fan is translated to the convection fan.

10. A cooking appliance comprising:

a cabinet including top, bottom rear and opposing side walls;

a cooking chamber including top, bottom, rear and opposing side walls and a frontal opening;

a door movably mounted relative to the cooking chamber for selectively closing the frontal opening;

an air emitter plate forming a portion of the top wall of the cooking chamber, said air emitter plate including a plurality of apertures leading to the air delivery portion and a recessed channel, integrally formed in the air emitter plate, including a plurality of openings that lead to the air delivery portion; and a radiant heating device nested at least partially within the recessed channel with the openings in the recessed portion directing air currents past the radiant heating device into the cooking chamber for performing a portion of a cooking operation.

11. The cooking appliance according to claim 10, wherein the recessed channel is constituted by first and second recessed channels having a serpentine configuration.

12. The cooking appliance according to claim 11, wherein the radiant heating device is constituted by first and second heating elements, said first and second heating elements being nested within the first and second recessed channels.

13. The cooking appliance according to claim 12, wherein the first and second heating elements have a heat output of 900 Watts.

14. The cooking appliance according to claim 13, wherein the first and second heating elements each have an output of 60 Watts/in$^2$.

15. The cooking appliance according to claim 14, wherein the first and second heating elements are constituted by sheathed, electric resistive elements.

16. A method of combining cooking techniques to cook a food item comprising:

placing a food item onto a conductive heating device positioned in a cooking chamber of a cooking appliance;

directing a microwave energy field into the cooking chamber;

activating a radiant heating device positioned in the cooking chamber to provide radiant energy in the cooking chamber;

operating a convection fan unit including a convective heating element to deliver a convective air flow into the cooking chamber; and combining the microwave energy field, radiant energy and convective air flow to cook the food item with the radiant energy and convective air flow heating the conductive heating device to provide a thermal conduction path that contributes to cooking the food item.

* * * * *